US008847773B2

(12) United States Patent
Rauworth et al.

(10) Patent No.: US 8,847,773 B2
(45) Date of Patent: Sep. 30, 2014

(54) COMBINATION CO/SMOKE DETECTOR WITH REVERSE COMPATIBLE INITIATING CIRCUIT

(75) Inventors: Timothy A. Rauworth, West Chicago, IL (US); Fred N. Merkle, Chicago, IL (US)

(73) Assignee: Honeywell International Inc., Morristown, NJ (US)

( * ) Notice: Subject to any disclaimer, the term of this patent is extended or adjusted under 35 U.S.C. 154(b) by 873 days.

(21) Appl. No.: 13/045,428

(22) Filed: Mar. 10, 2011

(65) Prior Publication Data

US 2012/0229285 A1 Sep. 13, 2012

(51) Int. Cl.

| | |
|---|---|
| ***G08B 21/00*** | (2006.01) |
| ***G08B 17/10*** | (2006.01) |
| ***G08B 21/14*** | (2006.01) |
| *G08B 29/18* | (2006.01) |

(52) U.S. Cl.

CPC ..... *G08B 17/10* (2013.01); *G08B 29/183* (2013.01); *G08B 21/14* (2013.01)

USPC ..... 340/632; 340/628; 340/521

(58) Field of Classification Search

CPC ..... G08B 17/10; G08B 21/14

USPC ..... 340/505, 506, 514, 521, 522, 584, 628, 340/629, 630, 632

See application file for complete search history.

(56) References Cited

U.S. PATENT DOCUMENTS 5,557,262 A * 9/1996 Tice ..... 340/587

* cited by examiner

*Primary Examiner* — Jeffery Hofsass

(74) *Attorney, Agent, or Firm* — Husch Blackwell LLP

(57) ABSTRACT

A system that includes, a carbon monoxide detector and first and second connectors, the carbon monoxide detector connected across the first and second conductors, the first and second conductors having a voltage imposed on the conductors that supply power to the carbon monoxide detector, the carbon monoxide detector signals detected carbon monoxide by clamping the first and second conductors to a first voltage less than the imposed voltage; and the carbon monoxide detector signaling a fault within the carbon monoxide detector by clamping the first and second conductors to a second voltage less than the imposed voltage where the second voltage is different than the second voltage and also different than the first voltage.

20 Claims, 1 Drawing Sheet

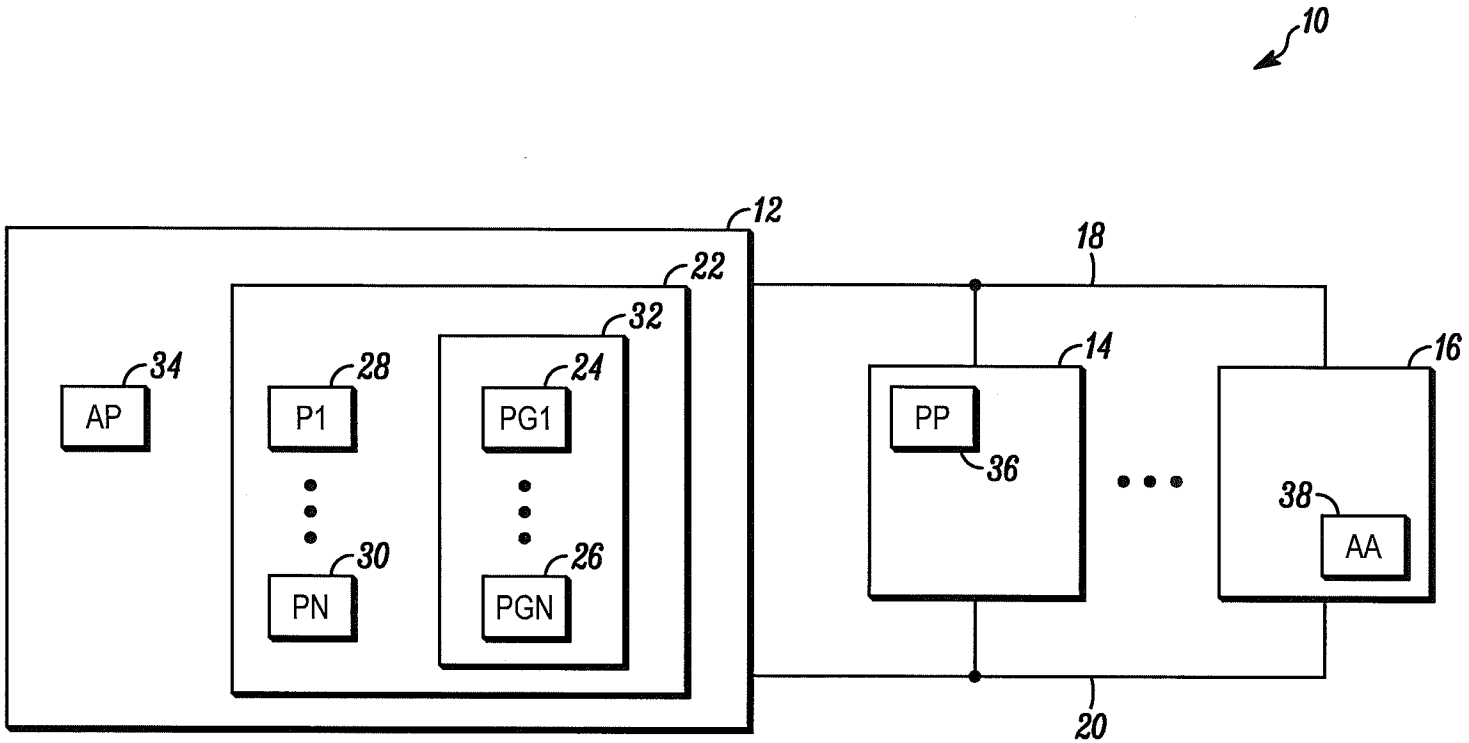
10
12
14
16
18
20
22
24
26
28
30
32
34
36
38
PG1
PGN
P1
PN
AP
PP
AA

COMBINATION CO/SMOKE DETECTOR WITH REVERSE COMPATIBLE INITIATING CIRCUIT

FIELD

The field of the invention relates to fire detection devices and more particularly to carbon monoxide detectors.

BACKGROUND

Devices for detecting fires are generally known. Smoke detectors are one example of such devices.

Fire detectors have found wide use in the home, office and industrial settings. As originally provided, most smoke detectors were battery powered with an audible alarm provided as an output to warn occupants of fires.

In the context of large buildings, including both offices and industrial setting, fire detection devices are connected to a central alarm panel. In this context, each of the fire detection devices is monitored by the central panel.

In addition to monitoring the fire detectors, the central panel may also activate visual and audible annunciators on or in the area of each of the devices. This is important were a fire is detected by a detector in one area, but it is important to provide a fire alert throughout the building or other protected areas in order to expedite the evacuation of the area.

More recently, municipalities have also begun to require the use of carbon monoxide detectors in buildings. This requirement has been motivated because improperly installed, maintained and/or ventilated fuel burning appliances can produce toxic carbon monoxide that cannot be detected through other means, such as smoke detectors.

On the other hand, carbon monoxide detectors do not operate the same way as smoke detectors. As such, carbon monoxide detectors cannot be mixed within a single standard zone type of an alarm system. Accordingly, a need exists for better ways of integrating the two technologies.

BRIEF DESCRIPTION OF THE DRAWING

FIG. 1 is a block diagram of a fire detection system including smoke detectors and carbon monoxide detectors in accordance with an illustrated embodiment of the invention.

DETAIL DESCRIPTION

FIG. 1 is block diagram of a fire detection system 10 shown generally in accordance with an illustrated embodiment of the invention. Included within the system 10 may be a control panel 12 and a number of fire detection devices 14, 16 that operate to detect fires within a protected area. The fire detection devices 14, 16 may include a mix of smoke detectors and carbon monoxide detectors.

As shown in FIG. 1, the fire detection devices 14, 16 may be electrically coupled to the panel 12 by first and second conductors 18, 20. In the two wire system of FIG. 1, the two conductors 18, 20 function to supply power from the panel 12 to the detectors 14, 16 as well as couple alarm signals from the detectors 14, 16 to the alarm panel 12.

One of the difficulties with prior art fire detection systems is that those prior systems could not easily mix smoke and carbon monoxide detectors within a single fire detection zone. Carbon monoxide and other types of fire detectors such as smoke detectors are generally not mixed in the same alarm zones because the information provided by each type of device represent a different type of risk and may be used differently in assessing danger.

Carbon monoxide detectors are required to indicate alarm at a threshold level of 10% COHb. This threshold is a function of time and concentration. Carbon monoxide detectors perform a very different function than smoke detectors. Because carbon monoxide detectors and smoke detectors perform different functions, and are required to send separate and distinct signals back to the control panel, they cannot be mixed within a single, conventional alarm zone connected to the alarm panel.

Because of the greater chance of false alarms, smoke detectors are not normally used with carbon monoxide detectors within the same zone in two-wire alarm systems. Smoke detectors are not normally used with carbon monoxide detectors within the same zone because if an alarm is received, it may not be possible to determine if the detected event was based upon smoke or carbon monoxide.

The alarm system 10 overcomes these problems. Within the alarm system 10, the smoke detectors 14, 16 and carbon monoxide detectors 14, 16 are each connected across a pair of conductors 18, 20 in a two-wire alarm system 10. Included within the system 10 is an alarm interface module 22 located within the panel 12 or connected between the conductors 18, 20 and the panel 12 that analyzes signals received on the conductors 18, 20 to determine the type of event that has been detected.

The panel 12 and each of the detectors 14, 16 may also include one or more programmed processors 28, 30, 36. The programmed processors 28, 30 within the panel 12 detect signals transmitted through the conductors 18, 20. The programmed processors 36 within the detectors 14, 16 generate the transmitted signals. The processors 28, 30, 36 are programmed with one or more computer programs or applications 24, 26 loaded from a non-transitory computer readable medium (memory) 32.

In this regard, the panel 12 imposes an open circuit operating voltage (e.g., 12 volts) across the conductors 18, 20. The voltage source within the panel 12 is imposed on the conductors 18, 20 through a resistor coupled in series with the voltage source. The resistor allows the open circuit voltage on the conductors 18, 20 to be pulled down to one or more signaling values used within the system 10.

During normal operation, the programmed processors 36 within each of the smoke detectors (e.g., one of 14 and 16) monitor the environment surrounding the smoke detector 14, 16 within the secured area. During normal monitoring, the voltage on the conductors 18, 20 remains near the open circuit value. Upon detecting smoke, the programmed processor 36 of the respective smoke detector 14, 16 clamps or otherwise pulls the voltage on the conductors 18, 20 down to a first predetermined voltage (e.g., 8.5 volts) that is less than the open circuit voltage imposed by the voltage source for some predetermined time period.

Within the alarm panel 12, the smoke detection processors 28, 30 monitor the voltage across the conductors 18, 20. In this regard, the smoke detection processors 28, 30 are provided with a smoke detection threshold voltage value that corresponds to the first voltage. The smoke detection processors 28, 30 are programmed to continuously compare the voltage across the conductors 18, 20 with the smoke detection threshold value. Upon detecting the first voltage when the voltage across the conductors 18, 20 exceeds the smoke detection threshold voltage, the smoke detection processor 28, 30 transfers a smoke detected alarm signal to an alarm processor 34.

The carbon monoxide detectors 14, 16 operate in a similar manner. However, the carbon monoxide detectors 14, 16 may clamp the voltage across the conductors 18, 20 to second and third voltage values less than the open circuit value and where the second and third voltage values are each different from each other and are also each different than the first voltage value.

In this regard, a programmed processor 36 within each of the carbon monoxide detectors 14, 16 is programmed to continuously measure a carbon monoxide level within the secured area around the detector 14, 16. The measured level of carbon monoxide is integrated over time based upon an appropriate time versus concentration process. When the integrated value exceeds a carbon monoxide concentration threshold value, the programmed processor 36 clamps the voltage across the conductors 18, 20 to the second voltage value (e.g., 10 volts) for a predetermined time period.

Within the panel 12, one or more programmed carbon monoxide detectors 28, 30 are programmed to monitor the voltage across the conductors 18, 20. The programmed carbon monoxide detectors 28, 30 may compare the voltage across the conductors 18, 20 with a carbon monoxide detection threshold value that equals the second voltage. Upon detecting the second voltage in the case when the voltage across the conductors 18, 20 exceeds the carbon monoxide detection threshold voltage, the carbon monoxide detection processor 28, 30 transfers a carbon monoxide detected alarm signal to an alarm processor 34.

In addition to detecting carbon monoxide, each of the carbon monoxide detectors 14, 16 may also include one or more programmed trouble processors 36 that detect malfunctions or other operating defects within the carbon monoxide detector 14, 16. The trouble processor 36 may perform one or more tests or measurements of its own circuits and also of the carbon monoxide sensor element. When the trouble processor 36 detects trouble within the carbon monoxide detector 14, 16, the trouble processor 36 clamps the voltage across the conductors 18, 20 to the third voltage value (e.g., 11 volts).

Within the panel 12, one or more programmed trouble detection processors 28, 30 may monitor the voltage levels across the conductors 18, 20 for the third voltage value. As above, the trouble detection processors 28, 30 may compare the voltage across the conductors 18, 20 with a trouble detection threshold voltage value. When the voltage across the conductors 18, 20 exceeds the third voltage, the trouble detection processors 28, 30 may send a trouble detected signal to a display screen of the panel 12.

The alarm processor 34 may be programmed to continuously monitor for smoke and carbon monoxide alarm signals from the respective processors 28, 30. Once detected, the alarm processor 34 may activate an audible and visible alarm annunciator 38 within each of the detectors 14, 16. In order to activate the annunciators 38, the alarm processor 34 may reverse the voltage imposed across the conductors 18, 20. More specifically, the alarm processor 34 may remove the imposed voltage (e.g., +12 volts) across the conductors 18, 20 and re-impose a reversed voltage (e.g., −12 volts) across the conductors 18, 20.

In addition, the alarm processor 34 may modulate the re-imposed voltage with a cadence that unambiguously identifies the type of alarm. For example, upon receiving a smoke detection alarm message, the alarm processor 34 may impose the reversed voltage with a cadence including applying the reverse voltage as a first pulse sequence (e.g., one second on followed by one second off for three times followed by a silent period equal in length to the three pulses).

In contrast, upon receiving a carbon monoxide detection alarm message, the alarm processor 34 may impose the reversed voltage with a cadence including applying the reverse voltage as a second pulse sequence (e.g., one second on followed by one second off for four times followed by a silent period equal in length to the four pulses).

A specific embodiment of method and apparatus for incorporating carbon monoxide detectors into fire systems has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A system comprising:

a carbon monoxide detector;

first and second connectors, the carbon monoxide detector connected across the first and second conductors, the first and second conductors having a voltage imposed on the conductors that supply power to the carbon monoxide detector, the carbon monoxide detector signals detected carbon monoxide by clamping the first and second conductors to a first voltage less than the imposed voltage; and the carbon monoxide detector signaling a fault within the carbon monoxide detector by clamping the first and second conductors to a second voltage less than the imposed voltage where the second voltage is different than the first voltage.

2. The system as in claim 1 further comprising a fire detection system with the first and second conductors extending from a control panel of the fire detection system to the carbon monoxide detector and wherein the control panel imposes the voltage on the first and second conductors.

3. The system as in claim 1 further comprising a smoke detector coupled across the first and second conductors.

4. The system as in claim 3 wherein the smoke detector and carbon monoxide detector further comprise a single enclosure.

5. The system as in claim 3 further comprising the smoke detector signaling a detected fire to the fire detection panel by clamping the first and second conductors to a third voltage less than the imposed voltage and different than the first and second voltages.

6. The system as in claim 5 further comprising a programmed processor within the control panel that detects at least one of the first, second and third voltages and that activates an audible alarm in response to the detected voltage.

7. The system as in claim 6 wherein the audible alarm is disposed within one of the smoke detector and the carbon monoxide detector.

8. A system comprising:

a fire detection control panel;

first and second conductors extending from the fire detection control panel, the fire detection panel imposing a voltage on the first and second conductors;

a smoke detector connected across the first and second conductors, the smoke detector signals a detected fire to the fire detection panel by clamping the first and second conductors to a first voltage less than the imposed voltage;

a carbon monoxide detector connected across the first and second conductors, the carbon monoxide detector signals detected carbon monoxide by clamping the first and second conductors to a second voltage less than the imposed voltage where the second voltage is different than the first voltage; and a carbon monoxide detector connected across the first and second conductors, the carbon monoxide detector signals fault by clamping the first and second conductors to a third voltage less than the imposed voltage where the third voltage is greater than the second voltage and also different than the first voltage.

9. The system as in claim 8 wherein the fire detection control panel further comprising a detector module coupled across the first and second conductors that compares a fire detection threshold value equal to the first voltage to a voltage detected across the first and second conductors and sends a fire detected signal to a programmed processor of the fire detection control panel upon detecting that the voltage across the first and second conductors exceeds the fire detection threshold value.

10. The system as in claim 9 wherein the fire detection control panel further comprising a detector module coupled across the first and second conductors that compares a carbon monoxide detection threshold value equal to the second voltage to a voltage detected across the first and second conductors and sends a carbon monoxide detected signal to a programmed processor of the fire detection control panel upon detecting that the voltage across the first and second conductors exceeds the carbon monoxide detection threshold value.

11. The system as in claim 10 wherein the fire detection control panel further comprising a detector module coupled across the first and second conductors that compares a carbon monoxide detector trouble detection threshold value equal to the third voltage to a voltage detected across the first and second conductors and sends a carbon monoxide detector trouble detected signal to a display of the fire detection control panel upon detecting that the voltage across the first and second conductors exceeds the carbon monoxide detector trouble detection threshold value.

12. The system as in claim 11 wherein the fire detection panel further comprises a programmed processor that removes the imposed voltage from the first and second conductors upon detection of a predefined event and re-imposes a reverse voltage across the first and second conductors, the reverse voltage activating an audible annunciator within the smoke detector and the carbon monoxide detector.

13. The system as in claim 12 wherein the predetermined event further comprises receipt of the fire detected signal.

14. The system as in claim 13 further comprising a programmed processor that pulses the re-imposed reversed signal at a first predetermined pulse rate that, thereby, generates a pulsed audible sound indicating the presence of a fire.

15. The system as in claim 12 wherein the predetermined event further comprises receipt of the carbon monoxide detected signal.

16. The system as in claim 12 further comprising a programmed processor that pulses the re-imposed reversed signal at a second predetermined pulse rate that, thereby, generates a pulsed audible sound from the smoke detector and carbon monoxide detector indicating the presence of a carbon monoxide.

17. A system comprising:

a smoke detector;

a carbon monoxide detector; and first and second conductors extending between the smoke detector and carbon monoxide detector, the first and second conductors having a voltage imposed thereon, the smoke detector signals a detected fire by clamping the first and second conductors to a first voltage less than the imposed voltage, the carbon monoxide detector signals detected carbon monoxide by clamping the first and second conductors to a second voltage less than the imposed voltage where the second voltage is different than the first voltage; and the carbon monoxide detector connected across the first and second conductors and the carbon monoxide detector signals a fault within the carbon monoxide detector by clamping the first and second conductors to a third voltage less than the imposed voltage where the third voltage is greater than the second voltage and also different than the first voltage.

18. The system as in claim 17 further comprising a fire detection system with the first and second conductors extend from a control panel of the fire detection system to the smoke and carbon monoxide detectors and wherein the control panel imposes the voltage on the first and second conductors.

19. The system as in claim 18 further comprising a programmed processor within the control panel that detects at least one of the first, second and third voltages and that activates an audible alarm in response to the detected voltage.

20. The system as in claim 18 wherein the audible alarm has a first cadence upon detection of the first voltage and a second, different cadence upon detection of the second voltage.

* * * * *